US007857515B2

(12) United States Patent
Dais et al.

(10) Patent No.: US 7,857,515 B2
(45) Date of Patent: Dec. 28, 2010

(54) AIRTIGHT CLOSURE MECHANISM FOR A RECLOSABLE POUCH

(75) Inventors: Brian C. Dais, Saginaw, MI (US); Robert R. Turvey, Sanford, MI (US); James C. Pawloski, Bay City, MI (US); Bryan L. Ackerman, Freeland, MI (US); Daniel P. Zimmerman, Livonia, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 865 days.

(21) Appl. No.: 11/818,585

(22) Filed: Jun. 15, 2007

(65) Prior Publication Data

US 2008/0310773 A1 Dec. 18, 2008

(51) Int. Cl.
*B65D 33/16* (2006.01)
*B65D 33/01* (2006.01)
*A44B 19/00* (2006.01)

(52) U.S. Cl. ..... 383/59; 383/63; 383/103; 24/585.12

(58) Field of Classification Search ..... 383/59, 383/63, 103, 65, 68; 24/585.12
See application file for complete search history.

(56) References Cited

U.S. PATENT DOCUMENTS

| | | | |
|---|---|---|---|
| 2,576,322 | A | 11/1951 | Waters |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |

(Continued)

FOREIGN PATENT DOCUMENTS

| | | |
|---|---|---|
| CA | 1315746 | 4/1993 |

(Continued)

*Primary Examiner*—Jes F Pascua

(57) ABSTRACT

An airtight closure mechanism for a reclosable pouch includes first and second complementary closure elements, the first closure element comprising a first interlocking profile and the second closure element comprising a complementary second interlocking profile. First and second sealing sections are disposed on respective complementary sides of the first and second interlocking profiles. The first sealing section includes a first protuberance having a first distal surface, a second protuberance having a second distal surface, and a sealing flange attached to and extending between the first and second distal surfaces of the first and second protuberances, respectively. The second sealing section includes a sealing member disposed on a base of the second closure element. The sealing member is located a distance from the second interlocking profile that places a distal surface thereof between the first and second protuberances when the first and second interlocking profiles are occluded. Additionally, when the first and second interlocking profiles are occluded, the distal surface urges against the sealing flange to form an airtight seal therebetween.

20 Claims, 8 Drawing Sheets

U.S. PATENT DOCUMENTS

| | | | | |
|---|---|---|---|---|
| 2,927,722 | A | | 3/1960 | Metzger |
| 2,960,144 | A | | 11/1960 | Graf |
| 3,026,231 | A | | 3/1962 | Chavannes |
| 3,060,985 | A | | 10/1962 | Vance et al. |
| 3,077,428 | A | | 2/1963 | Heuser et al. |
| 3,098,563 | A | | 7/1963 | Skees |
| 3,102,676 | A | | 9/1963 | Danelli et al. |
| 3,113,715 | A | | 12/1963 | Pangrac |
| 3,141,221 | A | | 7/1964 | Faulls, Jr. |
| 3,142,599 | A | | 7/1964 | Chavannes |
| 3,149,772 | A | | 9/1964 | Olsson |
| 3,160,323 | A | | 12/1964 | Weisberg |
| 3,164,186 | A | * | 1/1965 | Weber et al. ..... 141/390 |
| 3,216,172 | A | | 11/1965 | Piazze |
| 3,219,084 | A | | 11/1965 | Ausnit et al. |
| 3,224,574 | A | | 12/1965 | McConnell |
| 3,237,844 | A | | 3/1966 | Hughes |
| 3,251,463 | A | | 5/1966 | Bodet |
| 3,302,859 | A | | 2/1967 | Perry |
| 3,325,084 | A | | 6/1967 | Ausnit |
| 3,372,442 | A | | 3/1968 | Ishimatsu |
| 3,381,887 | A | | 5/1968 | Lowry |
| 3,389,733 | A | | 6/1968 | Siegel |
| 3,411,698 | A | | 11/1968 | Reynolds |
| 3,423,231 | A | | 1/1969 | Lutzmann |
| 3,440,696 | A | | 4/1969 | Staller |
| 3,464,094 | A | | 9/1969 | Mates |
| 3,516,217 | A | | 6/1970 | Gildersleeve |
| 3,557,413 | A | | 1/1971 | Engle |
| 3,565,147 | A | | 2/1971 | Ausnit |
| 3,575,781 | A | | 4/1971 | Pezely |
| 3,595,467 | A | | 7/1971 | Goglio |
| 3,595,722 | A | | 7/1971 | Dawbarn |
| 3,595,740 | A | | 7/1971 | Gerow |
| 3,600,267 | A | | 8/1971 | McFedries, Jr. et al. |
| 3,608,439 | A | | 9/1971 | Ausnit |
| 3,628,720 | A | | 12/1971 | Schmedding |
| 3,633,642 | A | | 1/1972 | Siegel |
| 3,655,501 | A | | 4/1972 | Tesch |
| 3,661,677 | A | | 5/1972 | Wang |
| 3,679,511 | A | | 7/1972 | Ausnit |
| 3,746,215 | A | | 7/1973 | Ausnit et al. |
| 3,762,404 | A | | 10/1973 | Sakita |
| 3,780,781 | A | | 12/1973 | Uramoto |
| 3,790,992 | A | | 2/1974 | Herz |
| 3,799,427 | A | | 3/1974 | Goglio |
| 3,809,217 | A | | 5/1974 | Harrison |
| 3,833,166 | A | | 9/1974 | Murray |
| 3,908,070 | A | | 9/1975 | Marzolf |
| 3,918,131 | A | | 11/1975 | Ausnit |
| 3,937,396 | A | | 2/1976 | Schneider |
| 3,980,226 | A | | 9/1976 | Franz |
| 3,989,182 | A | | 11/1976 | Stearley |
| 4,000,846 | A | | 1/1977 | Gilbert |
| 4,020,884 | A | | 5/1977 | Jadot |
| 4,085,886 | A | | 4/1978 | Nishioka |
| 4,101,355 | A | | 7/1978 | Ausnit |
| 4,104,404 | A | | 8/1978 | Bieler et al. |
| 4,105,491 | A | | 8/1978 | Haase et al. |
| 4,122,993 | A | | 10/1978 | Glas |
| 4,134,535 | A | | 1/1979 | Barthels et al. |
| 4,155,453 | A | | 5/1979 | Ono |
| 4,186,786 | A | | 2/1980 | Kirkpatrick |
| 4,206,870 | A | | 6/1980 | DeVries |
| 4,212,337 | A | | 7/1980 | Kamp |
| 4,215,725 | A | | 8/1980 | Callet et al. |
| 4,246,288 | A | | 1/1981 | Sanborn, Jr. |
| 4,267,960 | A | | 5/1981 | Lind et al. |
| 4,310,118 | A | | 1/1982 | Kisida et al. |
| 4,332,344 | A | | 6/1982 | Strodthoff |
| 4,340,558 | A | | 7/1982 | Hendrickson |
| 4,354,541 | A | | 10/1982 | Tilman |
| 4,355,494 | A | | 10/1982 | Tilman |
| 4,363,345 | A | | 12/1982 | Scheibner |
| 4,364,989 | A | | 12/1982 | Moyle |
| 4,370,187 | A | | 1/1983 | Katagiri et al. |
| 4,372,921 | A | | 2/1983 | Sanderson et al. |
| 4,426,816 | A | | 1/1984 | Dean et al. |
| 4,430,070 | A | | 2/1984 | Ausnit |
| 4,449,243 | A | | 5/1984 | Platel |
| 4,470,153 | A | | 9/1984 | Kenan |
| 4,491,959 | A | | 1/1985 | Loefberg |
| 4,509,642 | A | | 4/1985 | Rowell |
| 4,524,460 | A | | 6/1985 | Twiehoff et al. |
| 4,528,224 | A | | 7/1985 | Ausnit |
| 4,532,652 | A | | 7/1985 | Herrington |
| 4,541,117 | A | | 9/1985 | Ashbeck |
| 4,550,546 | A | | 11/1985 | Raley et al. |
| 4,551,379 | A | | 11/1985 | Kerr |
| 4,566,131 | A | | 1/1986 | Achelpohl |
| 4,569,712 | A | | 2/1986 | Shibano et al. |
| 4,576,283 | A | | 3/1986 | Fafournoux |
| 4,576,285 | A | | 3/1986 | Goglio |
| 4,578,813 | A | | 3/1986 | Ausnit |
| 4,579,784 | A | | 4/1986 | Lemstra et al. |
| 4,581,764 | A | | 4/1986 | Plock et al. |
| 4,612,221 | A | | 9/1986 | Biel et al. |
| 4,653,661 | A | | 3/1987 | Buchner et al. |
| 4,658,434 | A | | 4/1987 | Murray |
| 4,660,355 | A | | 4/1987 | Kristen |
| 4,672,684 | A | | 6/1987 | Barnes et al. |
| 4,683,702 | A | | 8/1987 | Vis |
| 4,691,372 | A | | 9/1987 | Van Erden |
| 4,691,373 | A | | 9/1987 | Ausnit |
| 4,701,358 | A | | 10/1987 | Behr et al. |
| 4,702,376 | A | | 10/1987 | Pagliaro |
| 4,703,518 | A | * | 10/1987 | Ausnit ..... 383/63 |
| 4,705,174 | A | | 11/1987 | Goglio |
| 4,712,574 | A | | 12/1987 | Perrott |
| 4,715,494 | A | | 12/1987 | Heitzenröder et al. |
| 4,730,635 | A | | 3/1988 | Linden |
| 4,731,911 | A | | 3/1988 | Gould |
| 4,736,450 | A | | 4/1988 | Van Erden et al. |
| 4,736,451 | A | | 4/1988 | Ausnit |
| 4,747,702 | A | | 5/1988 | Scheibner |
| 4,752,992 | A | | 6/1988 | Kondo et al. |
| 4,756,628 | A | | 7/1988 | Branson |
| 4,756,629 | A | | 7/1988 | Tilman et al. |
| 4,778,282 | A | | 10/1988 | Borchardt et al. |
| 4,780,937 | A | | 11/1988 | Kusayama |
| 4,782,951 | A | | 11/1988 | Griesbach et al. |
| 4,784,885 | A | | 11/1988 | Carespodi |
| 4,787,754 | A | | 11/1988 | Herrington |
| 4,787,755 | A | | 11/1988 | Branson |
| 4,787,880 | A | | 11/1988 | Ausnit |
| 4,791,710 | A | | 12/1988 | Nocek et al. |
| 4,792,240 | A | | 12/1988 | Ausnit |
| 4,795,269 | A | | 1/1989 | Scheibner |
| 4,796,300 | A | | 1/1989 | Branson |
| 4,807,300 | A | | 2/1989 | Ausnit et al. |
| 4,812,056 | A | | 3/1989 | Zieke |
| 4,812,074 | A | | 3/1989 | Ausnit et al. |
| 4,817,188 | A | | 3/1989 | Van Erden |
| 4,825,514 | A | | 5/1989 | Akeno |
| 4,829,641 | A | | 5/1989 | Williams |
| 4,832,505 | A | | 5/1989 | Ausnit et al. |
| 4,834,554 | A | | 5/1989 | Stetler, Jr. et al. |
| 4,840,611 | A | | 6/1989 | Van Erden et al. |
| 4,841,603 | A | | 6/1989 | Ragni |
| 4,858,286 | A | | 8/1989 | Siegel |
| 4,859,259 | A | | 8/1989 | Scheibner |
| 4,863,286 | A | | 9/1989 | Branson |
| 4,869,725 | A | | 9/1989 | Schneider et al. |
| 4,875,259 | A | | 10/1989 | Appeldorn |

4,877,334 A 10/1989 Cope
4,878,763 A 11/1989 Ausnit
4,890,637 A 1/1990 Lamparter
4,890,935 A 1/1990 Ausnit et al.
4,892,414 A 1/1990 Ausnit
4,892,512 A * 1/1990 Branson ..... 493/194
4,896,775 A * 1/1990 Boeckmann et al. ..... 206/557
4,903,718 A 2/1990 Sullivan
4,907,321 A 3/1990 Williams
4,909,017 A 3/1990 McMahon et al.
4,911,960 A 3/1990 Mudge et al.
4,923,701 A 5/1990 VanErden
4,925,318 A 5/1990 Sorenson
4,928,829 A 5/1990 Di Bernardo
4,929,487 A 5/1990 Tilman et al.
4,930,904 A 6/1990 Gröner et al.
4,937,139 A 6/1990 Genske et al.
4,947,525 A 8/1990 Van Erden
4,949,527 A * 8/1990 Boeckmann et al. ..... 53/412
4,953,708 A 9/1990 Beer et al.
4,961,944 A 10/1990 Matoba et al.
4,964,739 A 10/1990 Branson et al.
4,965,108 A 10/1990 Biel et al.
4,966,470 A 10/1990 Thompson et al.
4,971,845 A 11/1990 Aaker et al.
4,985,192 A 1/1991 Roeder et al.
5,007,143 A 4/1991 Herrington
5,009,318 A 4/1991 Lepinoy
5,012,561 A 5/1991 Porchia et al.
5,017,021 A 5/1991 Simonsen et al.
5,022,530 A 6/1991 Zieke
RE33,674 E 8/1991 Uramoto
5,037,138 A 8/1991 McClintock et al.
5,041,316 A 8/1991 Parnell et al.
5,044,774 A 9/1991 Bullard et al.
5,053,091 A 10/1991 Giljam et al.
5,056,933 A 10/1991 Kamp
5,059,036 A 10/1991 Richison et al.
5,067,208 A 11/1991 Herrington, Jr. et al.
5,067,822 A 11/1991 Wirth et al.
5,069,962 A 12/1991 Okazaki et al.
5,070,584 A 12/1991 Dais et al.
5,088,162 A 2/1992 Allan
5,088,971 A 2/1992 Herrington
5,092,684 A 3/1992 Weeks
5,093,164 A 3/1992 Bauer et al.
5,093,188 A 3/1992 Dohrer
5,119,531 A 6/1992 Berger et al.
5,120,586 A 6/1992 Nedzu et al.
5,134,001 A 7/1992 Osgood
5,140,727 A 8/1992 Dais et al.
5,140,796 A 8/1992 Pope
5,141,577 A 8/1992 Porchia et al.
5,142,970 A 9/1992 ErkenBrack
5,167,454 A 12/1992 Woods et al.
5,168,586 A 12/1992 Small
5,170,990 A 12/1992 Kamiya et al.
5,174,658 A 12/1992 Cook et al.
5,177,332 A 1/1993 Fong
5,179,767 A 1/1993 Allan
5,186,543 A 2/1993 Cochran
5,188,461 A 2/1993 Sorenson
5,189,764 A 3/1993 Herrington et al.
5,192,135 A 3/1993 Woods et al.
5,198,055 A 3/1993 Wirth et al.
5,203,458 A 4/1993 Cornwell
5,208,096 A 5/1993 Dohrer
5,209,264 A 5/1993 Koyanagi
5,209,574 A 5/1993 Tilman
5,209,972 A 5/1993 Super et al.
5,211,481 A 5/1993 Tilman
5,212,855 A 5/1993 McGanty
5,216,787 A 6/1993 Custer et al.
5,228,271 A 7/1993 Wallace
5,235,731 A 8/1993 Anzai et al.
5,236,749 A 8/1993 Ewing
5,238,306 A 8/1993 Heintz et al.
5,240,112 A 8/1993 Newburger
5,242,516 A 9/1993 Custer et al.
5,242,757 A 9/1993 Buisine et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,254,073 A 10/1993 Richison et al.
5,263,777 A 11/1993 Domke
RE34,477 E 12/1993 Cornwell
5,272,794 A 12/1993 Hamatani et al.
5,283,932 A 2/1994 Richardson et al.
RE34,554 E 3/1994 Ausnit
5,293,672 A 3/1994 Tominaga et al.
5,300,354 A 4/1994 Harita et al.
5,301,394 A 4/1994 Richardson et al.
5,301,395 A 4/1994 Richardson et al.
5,308,666 A 5/1994 Borchardt
5,320,889 A 6/1994 Bettle, III
5,324,572 A 6/1994 Kuechler et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,342,684 A 8/1994 Carespodi
5,346,312 A 9/1994 Mabry et al.
5,351,369 A 10/1994 Swain
5,351,828 A 10/1994 Becker et al.
5,354,133 A 10/1994 Rapparini
5,356,222 A 10/1994 Kettner et al.
5,360,670 A 11/1994 Yonezu et al.
5,362,351 A 11/1994 Karszes
5,366,294 A 11/1994 Wirth et al.
5,368,394 A 11/1994 Scott et al.
5,369,847 A 12/1994 Naya et al.
5,371,925 A 12/1994 Sawatsky
5,376,392 A 12/1994 Ikegami et al.
5,382,470 A 1/1995 Vicik
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.
5,448,807 A 9/1995 Herrington, Jr.
5,450,963 A 9/1995 Carson
5,456,979 A 10/1995 Schirmer
5,462,473 A 10/1995 Sheller
5,469,966 A 11/1995 Boyer
5,474,818 A 12/1995 Ulrich et al.
5,480,030 A 1/1996 Sweeney et al.
5,492,241 A 2/1996 Barnett et al.
5,494,165 A 2/1996 Detrick
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka 5,540,557 A 7/1996 Carson
5,542,902 A 8/1996 Richison et al.
5,544,752 A 8/1996 Cox
5,545,419 A 8/1996 Brady et al.
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,566,429 A 10/1996 Martinez et al.
5,567,533 A 10/1996 Toney et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
RE35,567 E 7/1997 Newsome
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,693,283 A 12/1997 Fehn
5,699,838 A 12/1997 Catallo et al.
5,700,091 A 12/1997 Tanaka et al.
5,701,996 A 12/1997 Goto et al.
5,709,479 A 1/1998 Bell
5,709,915 A 1/1998 Tomic et al.
5,713,669 A 2/1998 Thomas et al.
5,718,024 A 2/1998 Robbins
5,729,876 A 3/1998 Johnson
5,730,919 A 3/1998 Wilfong et al.
5,733,619 A 3/1998 Patel et al.
5,735,317 A 4/1998 Wu
5,735,395 A 4/1998 Lo
5,749,493 A 5/1998 Boone et al.
5,749,658 A 5/1998 Kettner
5,753,895 A 5/1998 Olson et al.
5,769,772 A 6/1998 Wiley
5,770,287 A 6/1998 Miranda et al.
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,786,010 A 7/1998 Yannuzzi, Jr.
5,791,783 A 8/1998 Porchia et al.
5,794,315 A 8/1998 Crabtree et al.
5,804,265 A 9/1998 Saad et al.
5,827,163 A 10/1998 Kettner
5,829,884 A 11/1998 Yeager
5,830,545 A 11/1998 Frisk
5,833,791 A 11/1998 Bryniarski et al.
5,839,582 A 11/1998 Strong et al.
5,839,831 A 11/1998 Mazzocchi
5,839,832 A 11/1998 Hagino
5,843,578 A 12/1998 Sasaki et al.
5,855,498 A 1/1999 Spector
5,871,281 A 2/1999 Stolmeier et al.
5,871,790 A 2/1999 Monier et al.
5,874,155 A 2/1999 Gehrke et al.
5,875,611 A 3/1999 Plourde
5,881,881 A 3/1999 Carrington
5,882,120 A 3/1999 Bell
5,893,461 A 4/1999 Walters
5,893,645 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,919,547 A 7/1999 Kocher et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,965,224 A 10/1999 Chen et al.
5,967,664 A 10/1999 Giles et al.
5,971,613 A 10/1999 Bell
5,981,028 A 11/1999 Sugawa et al.
5,983,466 A 11/1999 Petkovsek
5,985,391 A 11/1999 Denehy et al.
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager
6,021,624 A 2/2000 Richison et al.
6,023,914 A 2/2000 Richison et al.
6,029,810 A 2/2000 Chen
6,030,122 A 2/2000 Ramsey et al.
6,033,113 A 3/2000 Anderson
6,033,114 A 3/2000 Grimm et al.
6,039,182 A 3/2000 Light
6,044,621 A 4/2000 Malin et al.
6,045,264 A 4/2000 Miniea
6,045,546 A 4/2000 Drago et al.
6,045,648 A 4/2000 Palmgren et al.
6,047,450 A 4/2000 Machacek et al.
6,056,439 A 5/2000 Graham
6,059,456 A 5/2000 May
6,059,457 A 5/2000 Spreche et al.
6,068,898 A 5/2000 Oyama
6,070,397 A 6/2000 Bachhuber
6,070,728 A 6/2000 Overby et al.
6,071,011 A 6/2000 Thomas et al.
6,071,626 A 6/2000 Frisk
6,074,096 A 6/2000 Tilman
6,076,967 A 6/2000 Beaudette
6,077,578 A 6/2000 Valyi 6,080,252 A 6/2000 Plourde
6,082,897 A 7/2000 Galomb
6,083,584 A 7/2000 Smith et al.
6,085,906 A 7/2000 Lambert
6,085,922 A 7/2000 Esser
6,092,931 A 7/2000 Tilman
6,103,050 A 8/2000 Krueger
6,110,090 A * 8/2000 Ausnit ..... 493/212
6,110,586 A 8/2000 Johnson
6,112,374 A 9/2000 Van Erden
6,116,781 A 9/2000 Skeens
6,117,505 A 9/2000 Weiss et al.
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,146,764 A 11/2000 Suokas et al.
6,148,588 A 11/2000 Thomas et al.
6,149,302 A 11/2000 Taheri
6,149,304 A 11/2000 Hamilton et al.
6,152,601 A 11/2000 Johnson
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,194,043 B1 2/2001 Fehn
6,202,849 B1 3/2001 Graham
6,203,867 B1 3/2001 Derkach et al.
6,203,915 B1 3/2001 Prissok et al.
6,209,287 B1 4/2001 Thieman
6,217,216 B1 4/2001 Taheri
6,218,024 B1 4/2001 Tamber et al.
6,220,754 B1 4/2001 Stiglic et al.
6,224,262 B1 5/2001 Hogan et al.
6,227,706 B1 5/2001 Tran
6,231,236 B1 5/2001 Tilman
6,231,975 B1 5/2001 Kong et al.
6,234,676 B1 * 5/2001 Galomb et al. ..... 383/63
6,240,941 B1 6/2001 Small et al.
6,244,021 B1 6/2001 Ausnit et al.
6,244,748 B1 6/2001 Kasai et al.
6,248,442 B1 6/2001 Kong et al.
6,257,763 B1 7/2001 Stolmeier et al.
6,270,257 B1 8/2001 Yeager
6,270,950 B1 8/2001 Bourdelais et al.
6,273,609 B1 8/2001 Johnson
6,274,181 B1 8/2001 Richison et al.
6,279,298 B1 8/2001 Thomas et al.
6,279,745 B1 8/2001 Huynen et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,294,264 B1 9/2001 Piper et al.
6,299,353 B1 10/2001 Piechocki et al.
6,299,720 B1 10/2001 Van Erden
6,303,199 B1 10/2001 Takada et al.
6,306,472 B1 10/2001 Buelow
6,316,114 B1 11/2001 Comer et al.
6,317,939 B1 11/2001 Malin
6,321,423 B1 11/2001 Johnson
6,334,711 B1 1/2002 Risgalla et al.
6,344,258 B1 2/2002 Rasmussen
6,345,911 B1 2/2002 Young et al.
6,347,437 B2 2/2002 Provan et al.
6,354,738 B1 3/2002 Buckman et al.
6,355,336 B1 3/2002 Wakabayashi et al.
6,357,915 B2 3/2002 Anderson
6,361,209 B1 3/2002 LaRue et al.
6,361,211 B1 3/2002 Tilman
6,361,212 B1 3/2002 Sprehe et al.
6,361,843 B1 3/2002 Smith et al.
6,364,530 B1 4/2002 Buchman
6,371,643 B2 4/2002 Saad et al.
6,371,644 B1 4/2002 Forman
6,372,359 B1 4/2002 Hayashi et al.
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,390,676 B1 5/2002 Colombo et al.
6,391,404 B1 5/2002 Rosenbaum et al.
6,402,375 B1 6/2002 Schreiter et al.
6,403,174 B1 6/2002 Copeta
6,408,872 B1 6/2002 Skeens et al.
6,413,597 B1 7/2002 Hirai
6,439,771 B1 8/2002 Herrington, Jr.
6,450,686 B1 9/2002 May
6,451,426 B2 9/2002 Kong et al.
6,461,042 B1 * 10/2002 Tomic et al. ..... 383/64
6,468,332 B2 10/2002 Goglio et al.
6,479,115 B2 11/2002 Fehn
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,500,505 B2 12/2002 Piper et al.
6,503,588 B1 1/2003 Hayashi et al.
6,505,383 B2 1/2003 Machacek et al.
6,506,464 B1 1/2003 Montenieri et al.
6,513,659 B1 2/2003 Ogura et al.
6,517,242 B1 2/2003 Buchman
6,521,312 B1 2/2003 Keiser
6,524,002 B2 2/2003 Tomic
6,526,632 B1 3/2003 Blythe et al.
6,527,003 B1 3/2003 Webster
6,527,444 B1 * 3/2003 Buchman ..... 383/36
6,530,870 B2 3/2003 Buchman et al.
6,533,456 B1 3/2003 Buchman
D473,761 S 4/2003 Wilk et al.
6,539,594 B1 4/2003 Kasai et al.
6,550,965 B2 4/2003 Shaffer et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,576,329 B2 6/2003 Kong
6,576,348 B2 6/2003 Eggers et al.
6,579,584 B1 6/2003 Compton
6,579,621 B1 6/2003 Shah
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,602,590 B2 8/2003 Ting et al.
6,604,634 B2 8/2003 Su
6,609,353 B1 8/2003 McMahon et al.
6,609,827 B2 8/2003 Bois et al.

6,611,996 B2 9/2003 Blythe et al.
6,620,474 B1 9/2003 Regnier et al.
6,622,857 B2 9/2003 Ohtsubo et al.
6,623,866 B2 9/2003 Migliorini et al.
6,632,021 B2 10/2003 Bois et al.
6,634,384 B2 10/2003 Skeens et al.
6,637,939 B2 10/2003 Huffer
6,656,548 B1 12/2003 Beckwith et al.
6,659,643 B2 12/2003 Plourde et al.
6,662,827 B1 12/2003 Clougherty et al.
6,663,284 B2 12/2003 Buckingham et al.
6,663,947 B2 12/2003 Freedman et al.
6,666,580 B2 12/2003 Bois
6,667,083 B2 12/2003 Hayashi et al.
6,675,982 B2 1/2004 Heil et al.
6,679,027 B2 1/2004 Schreiter
6,680,104 B2 1/2004 Boris et al.
6,682,792 B2 1/2004 Schmal et al.
6,691,383 B2 2/2004 Linton
6,692,147 B2 2/2004 Nelson
6,694,704 B1 2/2004 Ausnit
6,698,925 B2 3/2004 Bentsen
6,706,377 B2 3/2004 Peet
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,753,370 B2 6/2004 Nakatsukasa et al.
6,755,568 B2 6/2004 Malone et al.
6,767,131 B2 7/2004 Taheri
6,773,163 B2 8/2004 Ichikawa et al.
6,777,089 B1 8/2004 Königer et al.
6,780,146 B2 8/2004 Thomas et al.
6,786,641 B2 9/2004 Plourde
6,789,690 B2 9/2004 Nieh et al.
6,794,021 B2 9/2004 Bader
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,824,885 B2 11/2004 Fitch et al.
6,826,808 B2 12/2004 Kutschka
6,827,105 B1 12/2004 Marble et al.
6,827,492 B2 12/2004 Cook
6,830,377 B2 12/2004 Schneider
6,833,170 B1 12/2004 Knoerzer et al.
6,835,257 B2 12/2004 Perrine
6,837,268 B2 1/2005 Skeens et al.
6,845,598 B1 1/2005 Melchoir
6,846,107 B2 1/2005 Sweeney et al.
6,846,532 B1 1/2005 Bensur
6,846,551 B2 1/2005 Genske et al.
RE38,694 E 2/2005 Nelson
6,851,248 B2 2/2005 Knight et al.
6,854,886 B2 2/2005 Piechocki et al.
6,862,980 B2 3/2005 Heil et al.
6,872,458 B1 3/2005 Rudd et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,884,483 B2 4/2005 Hayashi et al.
6,901,637 B2 6/2005 Machacek
6,902,795 B1 6/2005 Ishii et al.
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,939,597 B2 9/2005 Winget et al.
6,945,392 B2 9/2005 Furukawa et al.
6,946,176 B2 9/2005 Jousse et al.
6,954,969 B1 10/2005 Sprehe
6,955,465 B2 10/2005 Machacek et al.
6,957,915 B2 10/2005 Tankersley
6,960,374 B1 11/2005 Terada et al.
6,964,519 B2 11/2005 ErkenBrack
6,974,256 B2 12/2005 Kinigakis et al.
6,976,669 B2 12/2005 Van Zijll Langhout et al.
6,979,495 B2 12/2005 Keung et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,001,659 B2 2/2006 Iriyama
7,004,209 B2 2/2006 Davis et al.
7,004,632 B2 2/2006 Hamilton et al.
7,011,615 B2 3/2006 Price et al.
7,022,058 B2 4/2006 Lee
7,026,417 B2 4/2006 Yang et al.
7,036,988 B2 5/2006 Olechowski
7,048,136 B2 5/2006 Havens et al.
7,051,762 B2 5/2006 Haamer
7,077,570 B2 7/2006 Fukumori et al.
7,077,923 B2 7/2006 Lin
7,087,130 B2 8/2006 Wu et al.
7,087,277 B2 8/2006 Yang et al.
7,090,397 B2 * 8/2006 Stolmeier ..... 383/64
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,144,615 B2 12/2006 Peiffer et al.
7,157,126 B2 1/2007 Cosentino et al.
7,162,779 B2 1/2007 MacHacek
7,163,338 B2 1/2007 McCracken et al.
7,178,555 B2 2/2007 Engel et al.
7,244,223 B2 7/2007 Hartman et al.
7,377,015 B2 * 5/2008 Long et al. ..... 24/399
7,496,992 B2 * 3/2009 Ausnit ..... 24/30.5 R
7,784,160 B2 * 8/2010 Dais et al. ..... 24/585.12
2001/0012550 A1 8/2001 Fehn
2001/0031371 A1 10/2001 Kong et al.
2001/0034999 A1 11/2001 Xiong et al.
2001/0038897 A1 11/2001 Curie et al.
2002/0012803 A1 1/2002 Kending
2002/0022144 A1 2/2002 Yang et al.
2002/0041964 A1 4/2002 Winget et al.
2002/0090151 A1 7/2002 Skeens et al.
2002/0097923 A1 7/2002 Dobreski et al.
2002/0124471 A1 9/2002 Anderson et al.
2002/0146551 A1 10/2002 Freedman et al.
2002/0160167 A1 10/2002 Bader
2002/0168118 A1 11/2002 Price
2002/0168119 A1 11/2002 Herrington, Jr.
2002/0168489 A1 11/2002 Ting et al.
2002/0168512 A1 11/2002 Eggers et al.
2002/0182390 A1 12/2002 Migliorini et al.
2002/0187326 A1 12/2002 Kong
2003/0012901 A1 1/2003 Bezek et al.
2003/0016887 A1 1/2003 Su
2003/0021925 A1 1/2003 Schmal et al.
2003/0024847 A1 2/2003 Malaspina
2003/0031387 A1 2/2003 Gipson et al.
2003/0053722 A1 3/2003 Eggermont 2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0175457 A1 9/2003 Jousse et al.
2003/0207061 A1 11/2003 Hayashi et al.
2003/0219174 A1 11/2003 Piechocki
2003/0219177 A1 11/2003 Salvaro
2003/0219557 A1 11/2003 Denehy et al.
2003/0223654 A1 12/2003 Gerrits
2003/0235669 A1 12/2003 Yang et al.
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0028856 A1 2/2004 Smith et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0058178 A1 3/2004 Yang et al.
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.
2004/0105600 A1 6/2004 Floyd, Jr.
2004/0114837 A1 6/2004 Koyanagi
2004/0136617 A1 7/2004 Gerrits
2004/0136618 A1 7/2004 Ausnit et al.
2004/0136622 A1 7/2004 Shigeta et al.
2004/0165794 A1 8/2004 Plourde et al.
2004/0177595 A1 9/2004 Kozak
2004/0191438 A1 9/2004 Cosentino et al.
2004/0208400 A1 10/2004 Linneweil
2004/0211698 A1 10/2004 Mak
2004/0213967 A1 10/2004 Peiffer et al.
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0014011 A1 1/2005 Oya
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037164 A1 2/2005 Wu et al.
2005/0042441 A1 2/2005 Peiffer et al.
2005/0042468 A1 2/2005 Peiffer et al.
2005/0061812 A1 3/2005 Vilalta et al.
2005/0063620 A1 3/2005 Anderson
2005/0065007 A1 3/2005 Wu et al.
2005/0069229 A1 3/2005 McCracken et al.
2005/0103798 A1 5/2005 Luigi
2005/0123748 A1 6/2005 Paris
2005/0135710 A1 6/2005 Melchoir
2005/0147330 A1 7/2005 Lee
2005/0172577 A1 8/2005 Oltrogge
2005/0190995 A1 9/2005 Koyanagi
2005/0196076 A1 9/2005 Tanaka et al.
2005/0205455 A1 9/2005 Harrison
2005/0208282 A1 9/2005 Wood et al.
2005/0220373 A1 10/2005 Wu
2005/0220374 A1 10/2005 Thomas et al.
2005/0220376 A1 10/2005 Tsukanome et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.
2005/0281493 A1 12/2005 Heinemeier et al.
2005/0281494 A1 12/2005 Allen et al.
2005/0282695 A1 12/2005 Yeager
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2005/0286813 A1 12/2005 Borchardt
2005/0286817 A1 12/2005 Hall et al.
2006/0008185 A1 1/2006 Borchardt
2006/0008187 A1 1/2006 Armstrong
2006/0013514 A1 1/2006 Wu
2006/0029299 A1 2/2006 Share et al.
2006/0030472 A1 2/2006 Hartman et al.
2006/0034551 A1 2/2006 Linneweil
2006/0035046 A1 2/2006 Lee
2006/0035777 A1 2/2006 Johnson
2006/0048483 A1 3/2006 Tilman et al.
2006/0050999 A1 3/2006 Blythe et al.
2006/0053749 A1 3/2006 Scanlan
2006/0072860 A1 4/2006 Wu
2006/0073291 A1 4/2006 Wu
2006/0076058 A1 4/2006 Rypstra
2006/0093242 A1 5/2006 Anzini et al.
2006/0104548 A1 5/2006 Schreiter
2006/0105166 A1 5/2006 Lischefski et al.
2006/0110079 A1 5/2006 Zimmerman et al.
2006/0111226 A1 5/2006 Anzini et al.
2006/0120632 A1 6/2006 Han
2006/0120633 A1 6/2006 Goldenberg et al.
2006/0131328 A1 6/2006 Anderson
2006/0157140 A1 7/2006 Bergman et al.
2006/0159372 A1 7/2006 Plourde et al.
2006/0159576 A1 7/2006 Bergman et al.
2006/0165316 A1 7/2006 Cheung
2006/0172137 A1 8/2006 Champion
2006/0177156 A1 8/2006 Owen et al.
2006/0179620 A1 8/2006 MacHacek
2006/0182371 A1 8/2006 Borchardt
2006/0193540 A1 8/2006 Borchardt
2006/0201576 A1 9/2006 Domenig
2006/0225787 A1 10/2006 Newrones et al.
2006/0228057 A1 10/2006 Newrones et al.
2006/0251841 A1 11/2006 Yang et al.
2006/0263497 A1 11/2006 Hoffman
2006/0283148 A1 12/2006 Zimmermann et al.
2006/0292322 A1 12/2006 Nakajima et al.
2007/0090109 A1 4/2007 Gustavsson
2007/0130733 A1 6/2007 Kasai
2007/0154118 A1 7/2007 Tilman et al.
2007/0172157 A1 7/2007 Buchman
2007/0232473 A1 10/2007 Hartman et al.

FOREIGN PATENT DOCUMENTS

DE 1 901 372 U 9/1964
DE 1 290 073 2/1969
DE 1 486 280 4/1969
DE 1 486 733 6/1969

| | | | |
|---|---|---|---|
| DE | 1 411 644 | | 7/1969 |
| DE | 23 31 862 | | 1/1975 |
| DE | 24 54 248 | | 5/1976 |
| DE | 27 47 071 | | 4/1979 |
| DE | 28 48 835 | | 5/1980 |
| DE | 33 12 887 | | 10/1984 |
| DE | 34 11 371 | | 10/1985 |
| DE | 35 21 373 | | 12/1986 |
| DE | 93 00 361 | | 1/1994 |
| DE | 43 05 065 | | 8/1994 |
| DE | 198 43 430 | | 2/2000 |
| EP | 144 011 | | 6/1985 |
| EP | 149 695 | | 7/1985 |
| EP | 373 833 | | 6/1990 |
| EP | 450 741 | | 10/1991 |
| EP | 505 057 | | 9/1992 |
| EP | 633 193 | | 1/1995 |
| EP | 729 901 | | 9/1996 |
| EP | 767 105 | | 4/1997 |
| EP | 808 776 | | 11/1997 |
| EP | 1 231 155 | | 8/2002 |
| EP | 1 407 681 | | 4/2004 |
| FR | 2 353 452 | | 6/1976 |
| FR | 2 380 953 | | 2/1978 |
| FR | 2 603 164 | | 3/1988 |
| FR | 2 695 108 | | 3/1994 |
| GB | 154244 | | 11/1919 |
| GB | 961222 | | 6/1964 |
| GB | 1016476 | | 1/1966 |
| GB | 1046963 | | 10/1966 |
| GB | 1121514 | | 7/1968 |
| GB | 1548244 | | 7/1979 |
| GB | 2028081 | | 3/1980 |
| GB | 1583503 | | 1/1981 |
| GB | 2237553 | | 5/1991 |
| JP | 55-090364 | | 7/1980 |
| JP | 57-21579 | | 2/1982 |
| JP | 61-166960 | | 10/1986 |
| JP | 62-99534 | | 6/1987 |
| JP | 62-192779 | | 8/1987 |
| JP | 63-6278 | | 1/1988 |
| JP | 63-6279 | | 1/1988 |
| JP | 63-203559 | | 8/1988 |
| JP | 1-099925 | | 4/1989 |
| JP | 1-279073 | | 11/1989 |
| JP | 3-212355 | | 9/1991 |
| JP | 4-13543 | | 2/1992 |
| JP | 4-13544 | | 2/1992 |
| JP | 4-60847 | | 5/1992 |
| JP | 5-051039 | | 3/1993 |
| JP | 5-124656 | | 5/1993 |
| JP | 6-3846 | | 1/1994 |
| JP | 6-99991 | | 4/1994 |
| JP | 6-329179 | | 11/1994 |
| JP | 7-839 | | 1/1995 |
| JP | 8-011942 | | 1/1996 |
| JP | 8-198274 | | 8/1996 |
| JP | 2000226041 | A * | 8/2000 |
| JP | 2000-281084 | | 10/2000 |
| JP | 2001-173818 | | 6/2001 |
| JP | 2001-233383 | | 8/2001 |
| JP | 2001-247137 | | 9/2001 |
| JP | 3294043 | | 5/2002 |
| JP | 2002173154 | A * | 6/2002 |
| JP | 2002-193273 | | 7/2002 |
| JP | 2002-302164 | | 10/2002 |
| JP | 2003-507264 | | 2/2003 |
| JP | 2004-123228 | | 4/2004 |
| JP | 2004-531435 | | 10/2004 |
| JP | 2004-359292 | | 12/2004 |
| JP | 2006044786 | A * | 2/2006 |
| WO | WO 88/07479 | | 10/1988 |
| WO | WO 98/57862 | | 12/1998 |
| WO | WO 01/94227 | | 12/2001 |
| WO | WO 02/14161 | | 2/2002 |
| WO | WO 02/30772 | | 4/2002 |
| WO | WO 02/074522 | | 9/2002 |
| WO | WO 03/001096 | | 1/2003 |
| WO | WO 2004/002840 | | 1/2004 |
| WO | WO 2004/002841 | | 1/2004 |
| WO | WO 2004/002850 | | 1/2004 |
| WO | WO 2004/078590 | | 9/2004 |
| WO | WO 2004/078591 | | 9/2004 |
| WO | WO 2004/078609 | | 9/2004 |
| WO | WO 2004/108556 | | 12/2004 |
| WO | WO 2004/108557 | | 12/2004 |
| WO | WO 2005/000706 | | 1/2005 |
| WO | WO 2005/016774 | | 2/2005 |
| WO | WO 2005/040005 | | 5/2005 |
| WO | WO 2006/127739 | | 11/2006 |
| WO | WO 2007/149656 | | 12/2007 |

* cited by examiner

AIRTIGHT CLOSURE MECHANISM FOR A RECLOSABLE POUCH

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The invention relates generally to an airtight closure mechanism for a reclosable pouch.

2. Description of the Background of the Invention

Thermoplastic pouch openings are frequently sealed using resealable closure assemblies. In addition, resealable closure mechanisms having a single pair of opposing elongate interlocking profiles that are occluded between a user's fingers to create a seal are known. Moreover, it is common to employ closure mechanisms having multiple pairs of elongate interlocking profiles when a stronger and more secure seal is desired.

Recently, efforts have been directed to developing improved closures for resealable packages. For example, one resealable closure mechanism has a first fastener profile that involves a first tape having a protrusion extending along the surface of the tape, and a second fastener profile that involves a second tape having a substantially C-shaped member extending along the surface of the tape. When the pouch is closed, front and back walls of the pouch are captured between the interlocked protrusion and C-shaped member.

Another closure assembly involves a slider-actuated closure mechanism where a thin pliable membrane gets captured between first and second interlockable profiles of the closure mechanism. The membrane may be initially connected to the tops of the profiles across a mouth of the bag such that two layers of membrane material are captured between the closure mechanism profiles. Additionally, the membrane forms a tamper proof hermetic seal in an unopened package that requires the membrane to be sliced open to allow access to the inside of the package.

In another closure assembly, interlocking rib and groove elements act to reclosably seal a pouch opening. A funnel-shaped bag is connected to inner walls of the pouch just below the rib and groove elements and when inverted, the funnel shaped bag may be disposed between the interlocking rib and groove elements.

An additional resealable closure assembly involves interlocking channels disposed along a pouch opening. A flexible strip extends along one side of the pouch up through the pouch and along the interlocking channel disposed on the side of the pouch. When the pouch is closed, the interlocking channels are pressed into each other with the flexible strip disposed between the interlocking channels.

In another closure assembly, a reclosable closure mechanism has a first profile and a second profile where the profiles have complementary bulbous members that interlock in a tight interference fit. The first profile is also provided with an asymmetrical arrow-shaped member that is interlockable with a groove element on the second profile.

In yet another closure assembly, a permanently closing plastic profile fastener has male and female profiles. The male profile is generally arrow-shaped and the female profile has a pair of side jaws which define a groove therebetween. The male profile is restrained from entering the female profile by a frangible diaphragm disposed across ends of the jaws of the female profile. The diaphragm blocks access into the female profile until a predetermined level of force is applied to push the profiles together, thereby fracturing the diaphragm and allowing the male profile to enter.

An additional closure assembly involves first and second mutually interlocking profiles having two sets of interlocking members. In addition, the central portion has at least one profile with a collapsible member. When the first and second mutually interlocking profiles are joined, the collapsible member compresses against the other profile to create a seal.

SUMMARY OF THE INVENTION

In one aspect of the present invention, an airtight closure mechanism for a reclosable pouch includes first and second complementary closure elements, the first closure element comprising a first interlocking profile and the second closure element comprising a complementary second interlocking profile. First and second sealing sections are disposed on respective complementary sides of the first and second interlocking profiles. The first sealing section includes a first protuberance having a first distal surface, a second protuberance having a second distal surface, and a sealing flange attached to and extending between the first and second distal surfaces of the first and second protuberances, respectively. The second sealing section includes a sealing member disposed on a base of the second closure element. The sealing member is located a distance from the second interlocking profile that places a distal surface thereof between the first and second protuberances when the first and second interlocking profiles are occluded. Additionally, when the first and second interlocking profiles are occluded, the distal surface urges against the sealing flange to form an airtight seal therebetween.

In another aspect of the present invention, a reclosable pouch includes first and second pouch sidewalls sealed to one another to define an opening. A one-way valve is disposed on or in at least one of the first or second pouch sidewalls. An airtight closure mechanism includes first and second closure elements that include first and second interlocking profiles, and first and second sealing sections, respectively. The first closure element is attached to the first sidewall and the second closure element is attached to the second sidewall proximate the opening to define a pouch interior. The first and second sealing sections are disposed on respective pouch interior sides of the first and second interlocking profiles, and the first sealing section includes a first protuberance having a first distal surface, a second protuberance having a second distal surface, and a sealing flange attached to and extending across the first and second distal surfaces of the first and second protuberances, respectively. The second sealing section includes a sealing member disposed on a base of the second closure element and located a distance from the second interlocking profile that places a distal surface thereof between the first and second protuberances when the first and second interlocking profiles are occluded. When the first and second interlocking profiles are occluded, the sealing member urges against the sealing flange to form an airtight seal therebetween.

In another aspect of the present invention, a sealing section for an airtight closure mechanism includes first and second sealing sections disposed on respective complementary sides of first and second closure elements. The first sealing section includes a first protuberance having a first distal surface, a second protuberance having a second distal surface, and a sealing flange attached to and extending across from the first and second distal surfaces of the first and second protuberances, respectively. The second sealing section includes a sealing member disposed on the second closure element and located on a base of the second closure element so as to urge against the sealing flange attached to and extending across from the first and second protuberances when the first and second closure elements are occluded to form an airtight seal therebetween.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
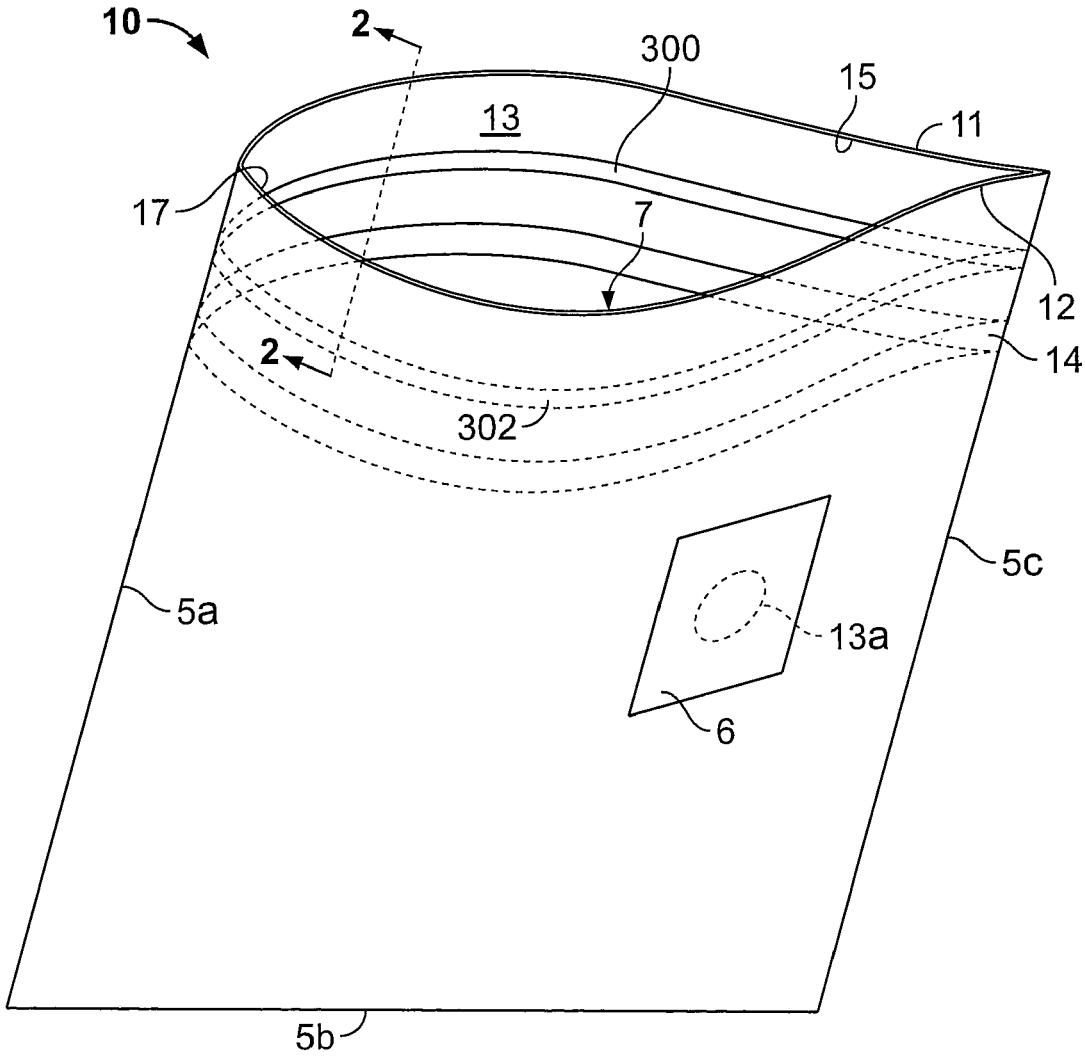
FIG. 1 is an isometric view of a reclosable pouch.

Referring to FIG. 1, a reclosable thermoplastic pouch 10 includes first and second sidewalls 11, 12 joined around three edges 5*a*-5*c* by heat sealing or other sealing method known in the art to define an opening 13. Alternatively, the bottom edge 5*b* may be a fold line between the first and second side walls 11, 12. A closure mechanism 14 extends from the first and second sidewalls 11, 12 proximate the pouch opening 13. The closure mechanism 14 and the first and second sidewalls 11, 12 define a pouch interior 7. When occluded, the closure mechanism 14 provides an airtight seal such that a vacuum may be maintained in the pouch interior 7 for a desired period of time, such as days, months, or years, when the closure mechanism is sealed fully across the opening 13. Protuberances, for example ridges 300, 302, may also be disposed on the inner surfaces 15, 17 of the respective first and second side walls 11, 12 proximate the opening 13 to provide increased traction in a convenient area for a user to grip, such as a gripping flange, when trying to open the sealed pouch 10.

In one embodiment, the pouch 10 may include a second opening 13*a* through one of the sidewalls 11, 12 covered by a valve 6, such as a check or one-way valve, to allow air to be evacuated from the pouch interior 7 and maintain a vacuum when the closure mechanism 14 has been sealed. As shown in FIG. 1, the valve 6 may be disposed on the second sidewall 12 spaced from the closure mechanism 14. When in an open state, the valve 6 provides a fluid path with fluid communication between the pouch interior 7 and an exterior of the pouch. Illustrative valves useful in the present invention include those disclosed in, for example, Newrones et al. U.S. Patent application publication No. 2006/0228057. Other valves useful in the present invention include those disclosed in, for example, Ser. Nos. 11/818,592, 11/818,586, and 11/818,591, each filed on the same day as the present application. Although not shown, in some embodiments an evacuation pump or device may be used to evacuate fluid from the pouch 10 through, for example, the valve 6 disposed in one of the side walls 11, 12, or in the closure mechanism 14 or one of the side edges 5*a*, 5*b*, 5*c* of the pouch. Illustrative evacuation pumps or devices useful in the present invention include those disclosed in, for example, Ser. No. 11/818,703 filed on the same day as the present application.

In one embodiment, the first and second sidewalls 11, 12 and/or the closure mechanism 14 are formed from thermoplastic resins by known extrusion methods. For example, the sidewalls 11, 12 may be independently extruded of thermoplastic material as a single continuous or multi-ply web, and the closure mechanism 14 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, inner surfaces 15, 17 of the respective sidewalls 11, 12 or a portion or area thereof may, for example, be composed of a polyolefin plastomer such as an AFFINITY™ resin manufactured by Dow Plastics. Such portions or areas include, for example, the area of one or both of the sidewalls 11, 12 proximate and parallel to the closure mechanism 14 to provide an additional cohesive seal between the sidewalls when the pouch 10 is evacuated of fluid. One or more of the sidewalls 11, 12 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 11, 12. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure mechanism 14 may be extruded primarily of molten PE with various amounts of slip component, colorant, and talc additives in a separate process. The fully formed closure mechanism 14 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

Although not shown, one or both sidewalls, such as the second sidewall 12, may also be embossed or otherwise textured with a pattern, such as a diamond pattern, on one or both surfaces spaced between the bottom edge 5*b* and the closure mechanism 14, or a separate textured or embossed patterned wall may be used to provide flow channels (not shown) within the pouch interior 7. The flow channels may provide fluid communication between the pouch interior 7 and the valve 6 when fluid is being drawn through the valve 6. Illustrative flow channels useful in the present invention include those disclosed in Zimmerman et al. U.S. Patent application publication No. 2005/0286808 and Tilman et al. U.S. Patent application publication No. 2006/0048483. Other flow channels useful in the present invention include those disclosed in, for example, Ser. No. 11/818,584 filed on the same day as the present application.

The resealable bag or pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Figure 2A:
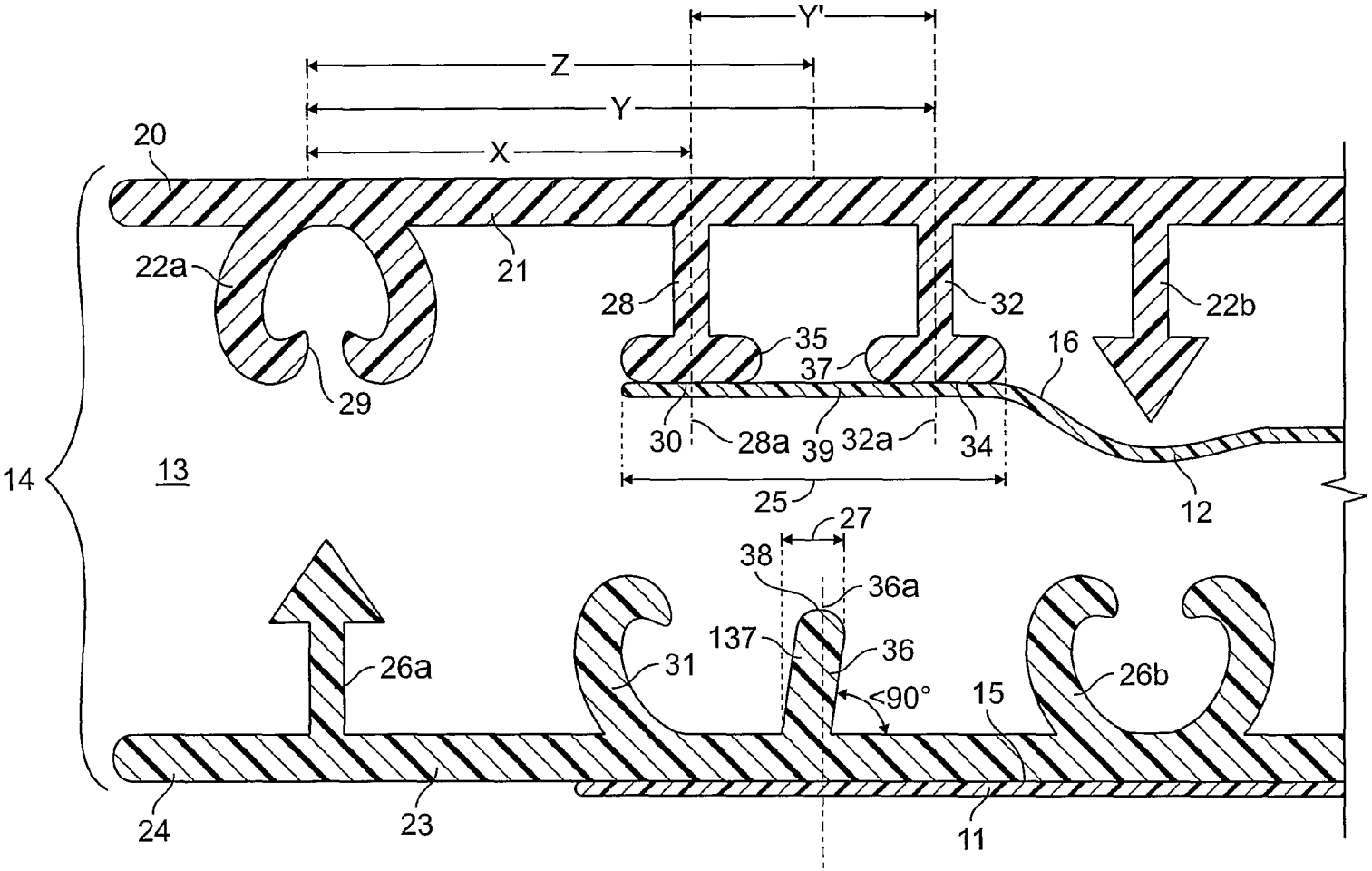
FIG. 2A is an enlarged partial cross-sectional view of an airtight closure mechanism in a non-occluded state in accordance with one embodiment of the present invention taken generally along the lines 2-2 of FIG. 1.
Figure 2B:
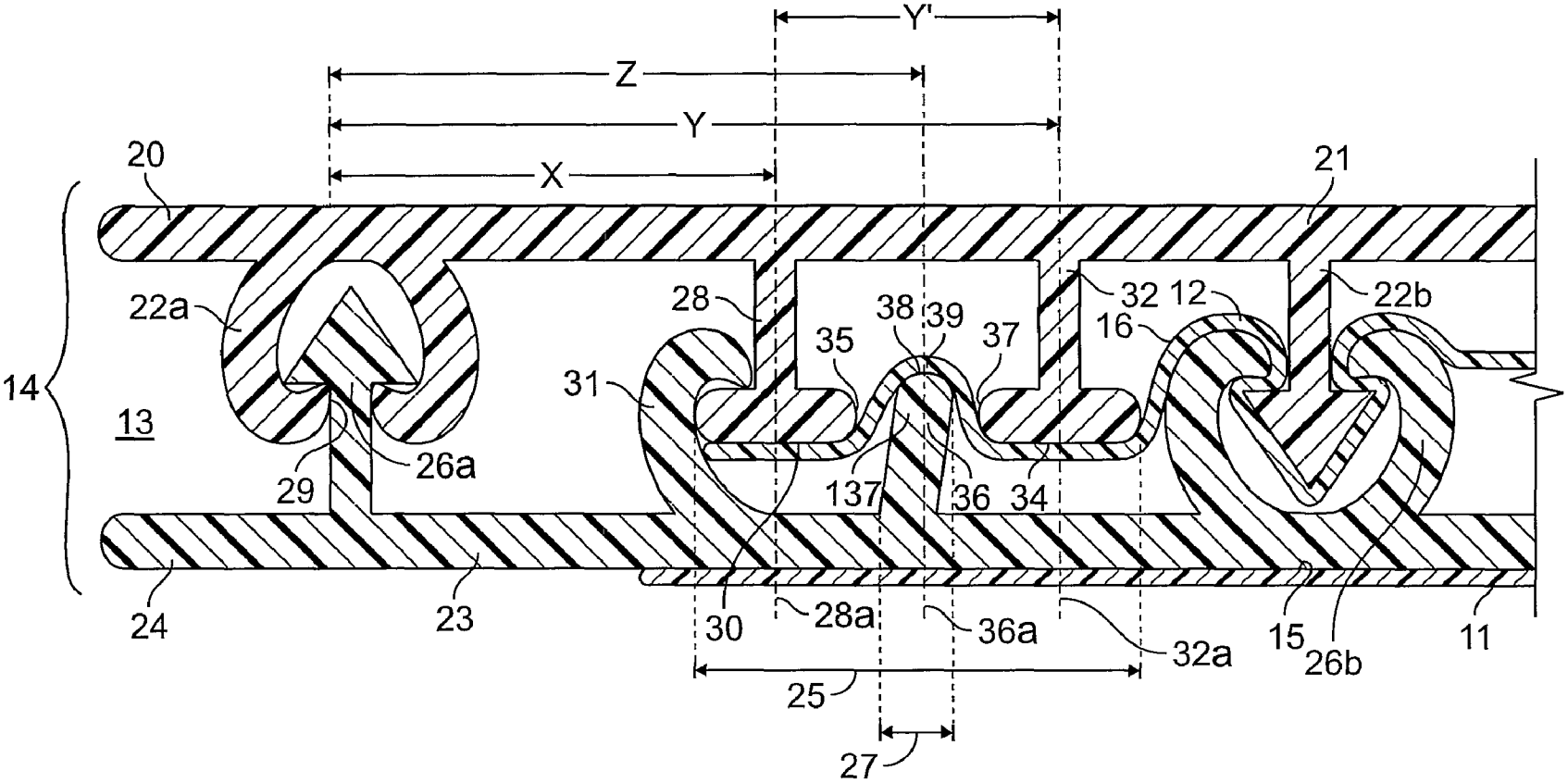
FIG. 2B is an enlarged partial cross-sectional view of an airtight closure mechanism in an occluded state in accordance with the embodiment of the present invention depicted in FIG. 2A.

Referring to FIGS. 2A and 2B, the closure mechanism 14 comprises a first closure element 20 that includes a first interlocking profile 22*a* and a second closure element 24 that includes a complementary second interlocking profile 26*a*. The first closure element 20 may also include a third interlocking profile 22*b* and the second closure element 24 may include a complementary fourth interlocking profile 26*b*. The first closure element 20 and second closure element 24 are elongate and extend along the opening 13 of the pouch 10. FIG. 2A depicts the first and second closure elements 20, 24 in a non-occluded state while FIG. 2B shows the first and second closure elements 20, 24 in an occluded state. In this embodiment, the first closure element 20 is attached to an outer surface 16 of the second sidewall 12, and the second closure element 24 is attached to the inner surface 15 of the first sidewall 11. The first and second interlocking profiles 22*a*, 26*a* are shown in FIGS. 2A and 2B as female and male closure profiles, respectively, and the third and fourth interlocking profiles 22*b*, 26*b* are shown in FIGS. 2A and 2B as male and female closure profiles, respectively. However, the configuration and geometry of the interlocking profiles 22*a*, 22*b*, 26*a*, 26*b* or closure elements 20, 24 shown herein may vary.

In a further embodiment, one or both of the first and second closure elements 20, 24 may include one or more textured portions, such as a bump or crosswise groove in one or more of the interlocking profiles 22*a*, 22*b*, 26*a*, 26*b* in order to provide a tactile sensation, such as a series of clicks, as a user draws the fingers along the closure mechanism 14 to seal the closure elements across the opening. In another embodiment, all of the closure profiles 22*a*, 22*b*, 26*a*, 26*b* include textured portions along the length of each profile to provide tactile and/or audible sensations when closing the closure mechanism 14. Further, in some embodiments, a sealing material such as a polyolefin material or a caulking composition such as silicone grease may be disposed on or in the interlocking profiles 22*a*, 22*b*, 26*a*, 26*b* or closure elements 20, 24 to fill in any gaps or spaces therein when occluded. The ends of the interlocking profiles 22*a*, 22*b*, 26*a*, 26*b* or closure elements 20, 24 may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, and Ser. Nos. 11/818,593 and 11/818,596 each filed on the same day as the present application. It is further appreciated that the interlocking profiles or closure elements disclosed herein may be operated by hand, or a slider (not shown) may be used to assist in occluding and de-occluding the interlocking profiles and closure elements.

As shown in FIGS. 2A and 2B, a first sealing section 25 is disposed on the first closure element 20 between the first and third interlocking profiles 22*a*, 22*b*, and includes a first protuberance 28 having a distal surface 30 and extending from an elongate first base 21 of the first closure element. A central axis 28*a* of the first protuberance 28 is located a distance X measured along the first base 21 from a line perpendicular to the base and through a distal end 29 of the first interlocking profile 22*a*. This spacing of the central axis 28*a* of the first protuberance 28 at distance X allows for proper securement of the first and the second closure elements 20, 24 and may range, for example, from greater than about 0.08 inches to less than about 0.20 inches. The first sealing section 25 also includes a second protuberance 32 having a distal surface 34 and extending from the elongate first base 21 of the first closure element 20. A central axis 32*a* of the second protuberance 32 is located a distance Y measured along the first base 21 from a line perpendicular to the base and through the distal end 29 of the first interlocking profile 22*a*. In this embodiment, the distance Y is greater than the distance X, and the difference is represented by distance Y'. Illustratively, the distance Y' between the central axes 28*a* and 32*a* allows for a sealing flange 39 to extend from and across the distal surfaces 30, 34 of the first and second protuberances 28, 32, respectively. In this embodiment, the sealing flange 39 is integral with the second pouch sidewall 12, and in other embodiments the sealing flange 39 is a separate piece of thermoplastic film.

A second sealing section 27 is disposed on the second closure element 24 between the second and fourth interlocking profiles 26*a*, 26*b*, and includes a sealing member 36 having a distal surface 38. In this embodiment, the distal surface 38 is disposed at an apex of a third protuberance 137 that extends from an elongate second base 23 of the second closure element. Although in this embodiment the third protuberance 137 is disposed at an angle of less than 90 degrees relative to the second base 23, it is also contemplated that the third protuberance may be disposed at angles of approximately 90 degrees or greater than 90 degrees. However, by having the third protuberance 137 at a non-90 degree angle, the force necessary to urge the sealing member 36 and the sealing flange 39 together may be less due to the flexibility of the third protuberance as force is applied thereto while the first and second closure elements 20, 24 are being occluded. This flexibility increases as the angle increases past 90 degrees or decreases to less than 90 degrees, and may in some instances assist in maintaining an airtight seal with the sealing flange 39. A central axis 36*a* of the distal surface 38 of the sealing member 36 is located a distance Z measured along the first base 21 from a line perpendicular to the base and through the distal end 29 of the first interlocking profile 22*a* when the closure elements 20 and 24 are occluded. In this embodiment, the central axis 36*a* of the distal surface 38 does not correspond to a central axis (not shown) of the third protuberance 137. The distance Z ranges between the distances X and Y in this embodiment, such that the central axis 36*a* is disposed between opposing outer edges 35, 37 of the distal surfaces 30, 34, respectively in the occluded state, as shown in FIG. 2B.

When the closure elements 20, 24 are urged together the first interlocking profile 22*a* interlocks with the second interlocking profile 26*a*, and the third interlocking profile 22*b* interlocks with the fourth interlocking profile 26*b*. In this embodiment, because the sealing flange 39 is integral with the second pouch sidewall 12, the third and fourth interlocking profiles 22*b*, 26*b* interlock with the sealing flange trapped therebetween. In other embodiments, the sealing flange 39 may be made of a thermoplastic film independent of the sidewalls 11, 12 such as, for example, an elastomer or a polyolefin plastomer such as an AFFINITY™ resin manufactured by Dow Plastics, and the third and fourth interlocking profiles 22*b*, 26*b* may interlock without the sealing flange trapped therebetween. Additionally, in the occluded state, the first protuberance 28 interlocks with an asymetrically-hooked protuberance 31 that extends from the elongate second base 23 of the second closure element 24. Although the first and second protuberances 28, 32 are illustrated in FIGS. 2A and 2B as T-shaped protuberances and a post shape is shown for the sealing member 36, other shapes may also be used, including for example, bulbous members, arrow or half-arrow shaped members, or rectangular, square-shaped, round, or triangular-shaped protrusions, as well as any combination thereof.

Figure 3A:
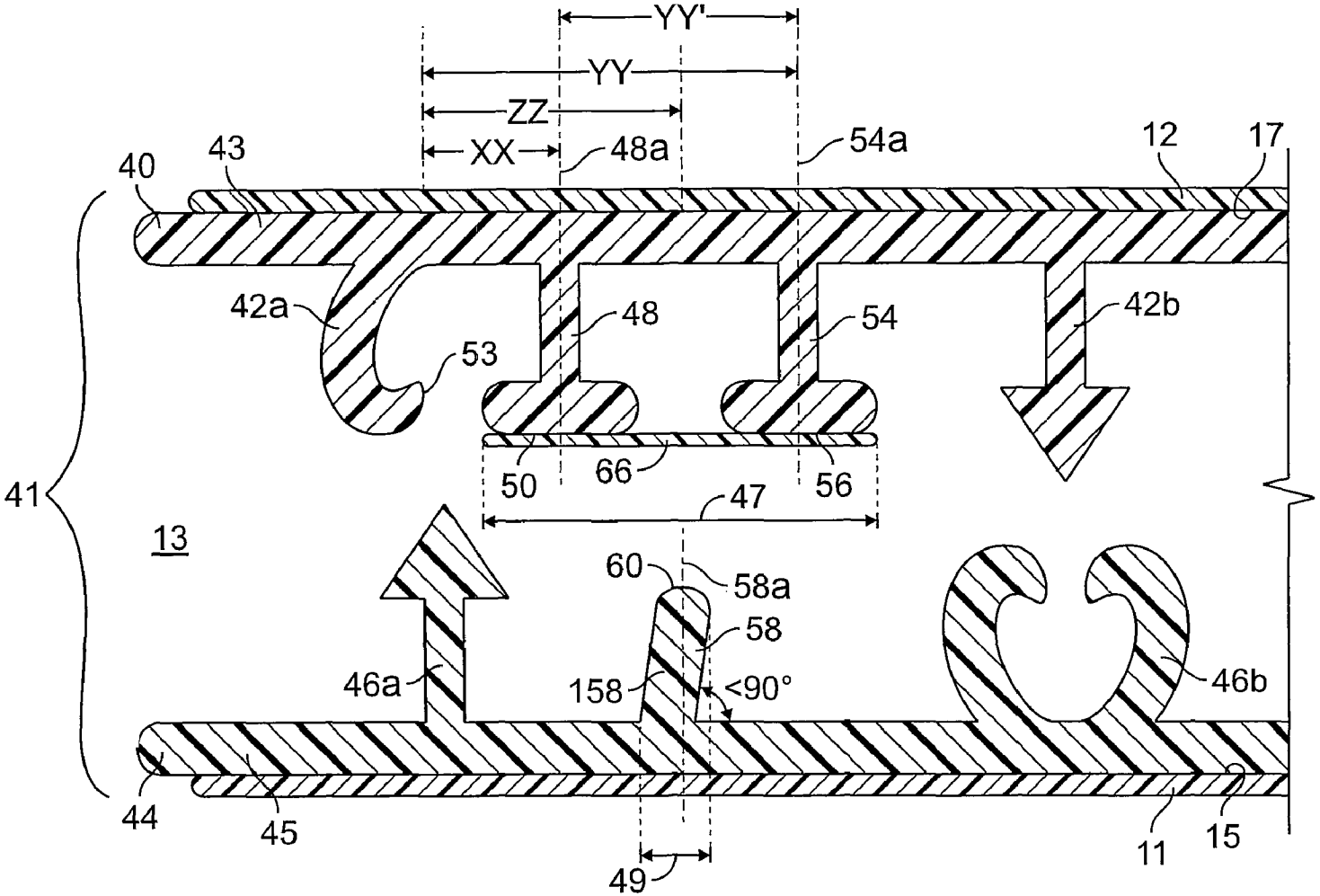
FIG. 3A illustrates an enlarged partial cross-sectional view of a second embodiment in a non-occluded state taken generally along the lines 2-2 of FIG. 1.
Figure 3B:
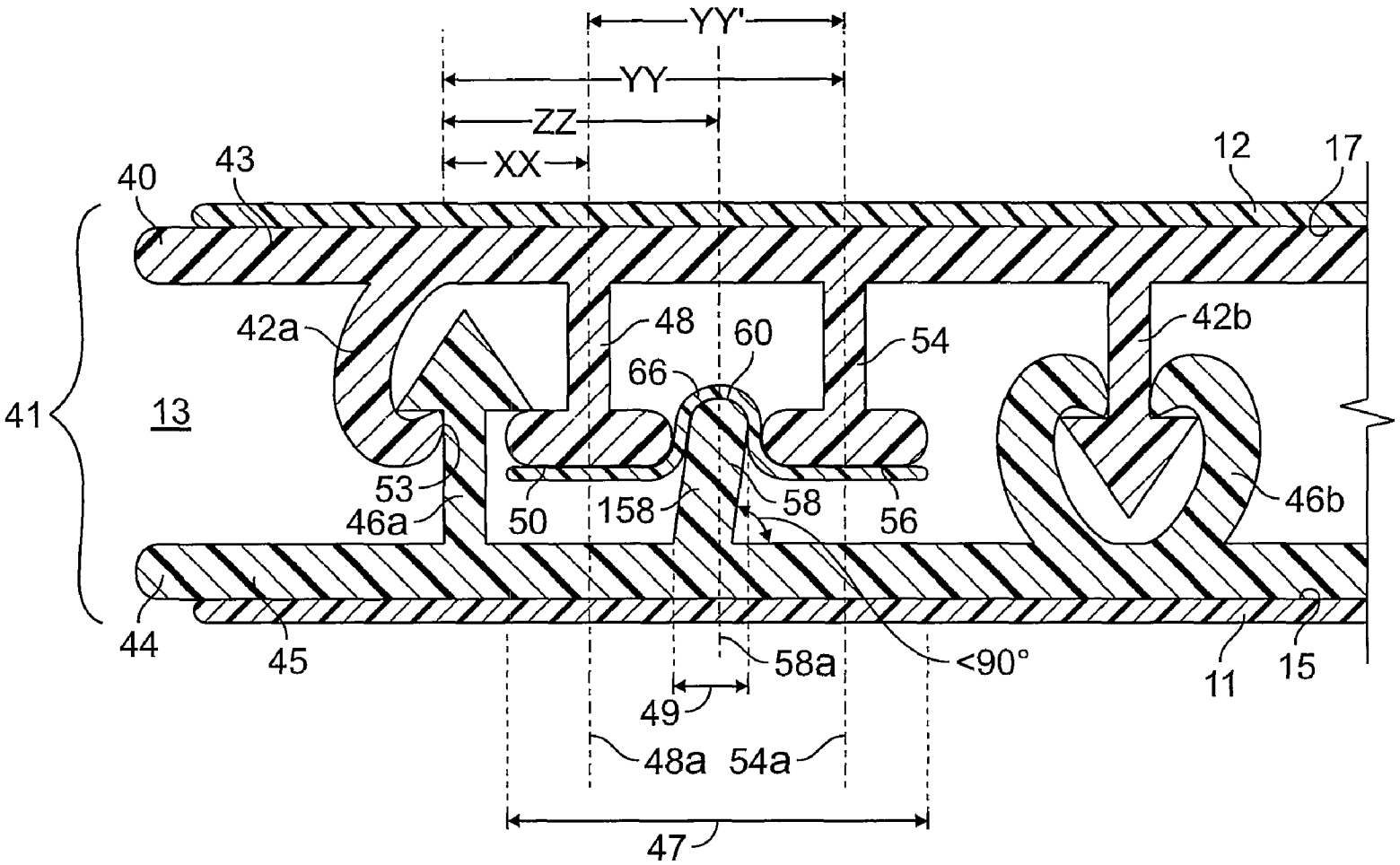
FIG. 3B illustrates an enlarged partial cross-sectional view of the embodiment depicted in FIG. 3A in an occluded state.

In another embodiment illustrated in FIGS. 3A and 3B, a closure mechanism 41 includes a first closure element 40 having a first interlocking profile 42*a* and a second closure element 44 having a complementary second interlocking profile 46*a*. The first closure element 40 may also include a third interlocking profile 42*b* and the second closure element 44 may include a complementary fourth interlocking profile 46*b*. FIG. 3A depicts the first and second closure elements 40, 44 in a non-occluded state while FIG. 3B shows the first and second closure elements 40, 44 in an occluded state. In this embodiment, the first closure element 40 is attached to the inner surface 17 of the second sidewall 12 and the second closure element 44 is attached to the inner surface 15 of the first sidewall 11. Illustratively, the first and fourth interlocking profiles 42*a*, 46*b* are shown as female and the second and third interlocking profiles 46*a*, 42*b* are shown as male closure profiles, however, the configuration and geometry of the interlocking profiles 42*a*, 42*b*, 46*a*, 46*b* or closure elements 40, 44 may vary as described previously herein. A first sealing section 47 extends from an elongate first base 43 of the first closure element 40 and contains a first protuberance 48 and a second protuberance 54 each having one or more sidewalls that extend substantially perpendicularly from the elongate first base 43. The first protuberance 48 has a distal surface 50 and a central axis 48*a* located a distance XX measured along the first base 43 from a line perpendicular to the base and through the distal end 53 of the first interlocking profile 42*a*. The second protuberance 54 has a distal surface 56 and a central axis 54*a* of the second protuberance 54 is located a distance YY measured along the first base 43 from a line perpendicular to the base and through the distal end 53 of the first interlocking profile 42*a*. In this embodiment, the distance YY is greater than the distance XX, and the difference is represented by distance YY'. A second sealing section 49 includes a sealing member 58 having a distal surface 60 disposed at an apex of a third protuberance 158 that extends similar to that as shown in FIGS. 2A and 2B at an angle of less than 90 degrees from an elongate second base 45 of the second closure element 44. The sealing member 58 has one or more sidewalls that extend substantially parallel to one another from the elongate second base 45. A central axis 58*a* of the distal surface 60 of the sealing member 58 is located a distance ZZ measured along the first base 43 from a line perpendicular to the base and through the distal end 53 of the first interlocking profile 42*a* when the closure elements 40 and 44 are occluded. In this embodiment, the central axis 58*a* of the distal surface 60 does not correspond to a central axis (not shown) of the third protuberance 158. A sealing flange 66 extends across and is attached to the distal surface 50 of the first protuberance 48 and the distal surface 56 of the second protuberance 54. In this embodiment, the sealing flange 66 may be made of a thermoplastic film independent of the sidewalls 11, 12 such as, for example, an elastomer or a polyolefin plastomer such as an AFFINITY™ resin. However, in other embodiments, the sealing flange 66 may be made of one of the sidewalls 11, 12 or of the same or similar material(s). When the first closure element 40 and the second closure element 44 are urged together, as shown in FIG. 3B, the first interlocking profile 42*a* interlocks with the second interlocking profile 46*a* and the third interlocking profile 42*b* interlocks with the fourth interlocking profile 46*b*. In the occluded state, the sealing member 58 is urged against the sealing flange 66 to form an airtight seal therebetween.

Figure 4A:
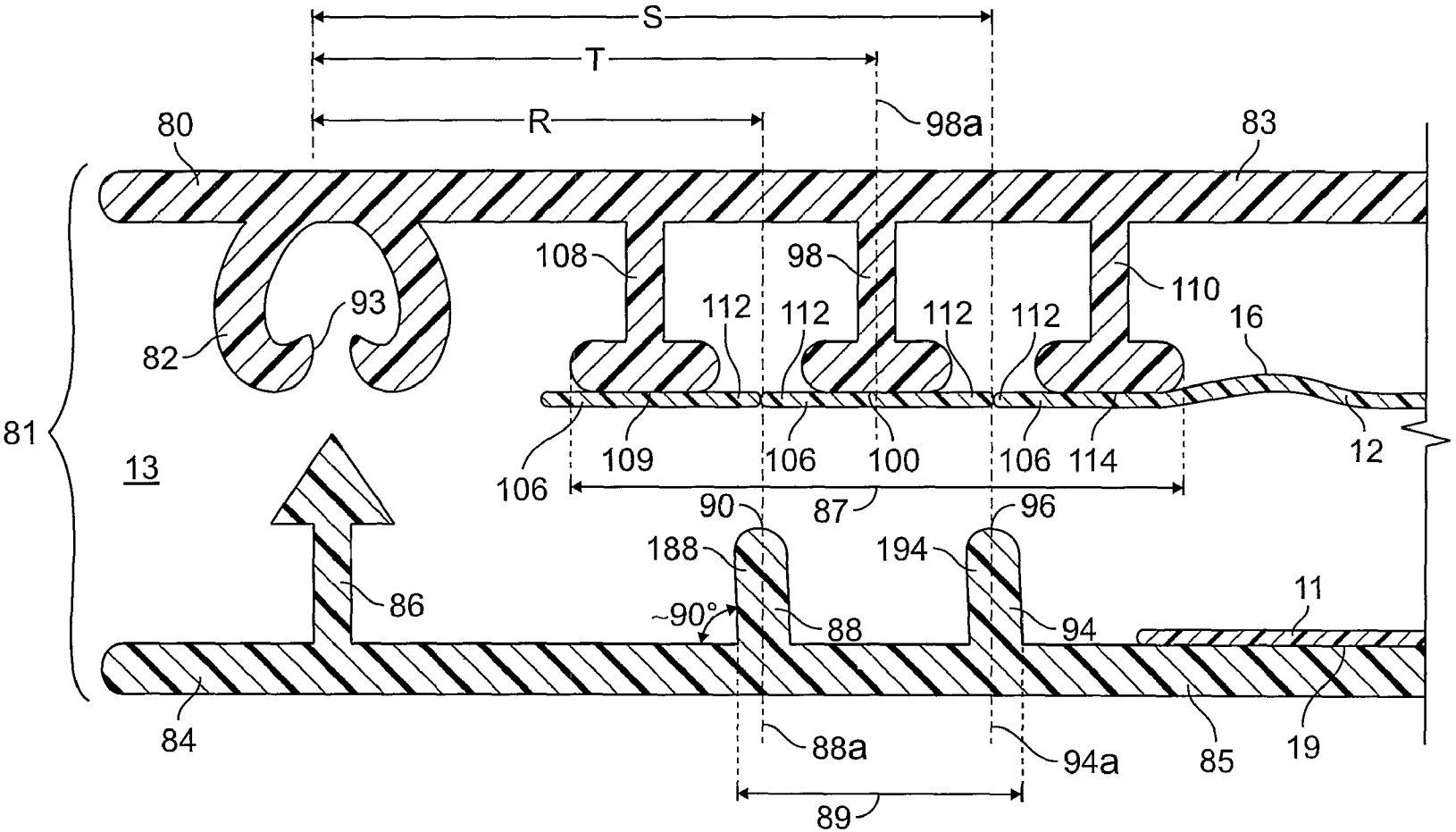
FIG. 4A is an enlarged partial cross-sectional view of a third embodiment of the present invention in a non-occluded state taken generally along the lines 2-2 of FIG. 1.
Figure 4B:
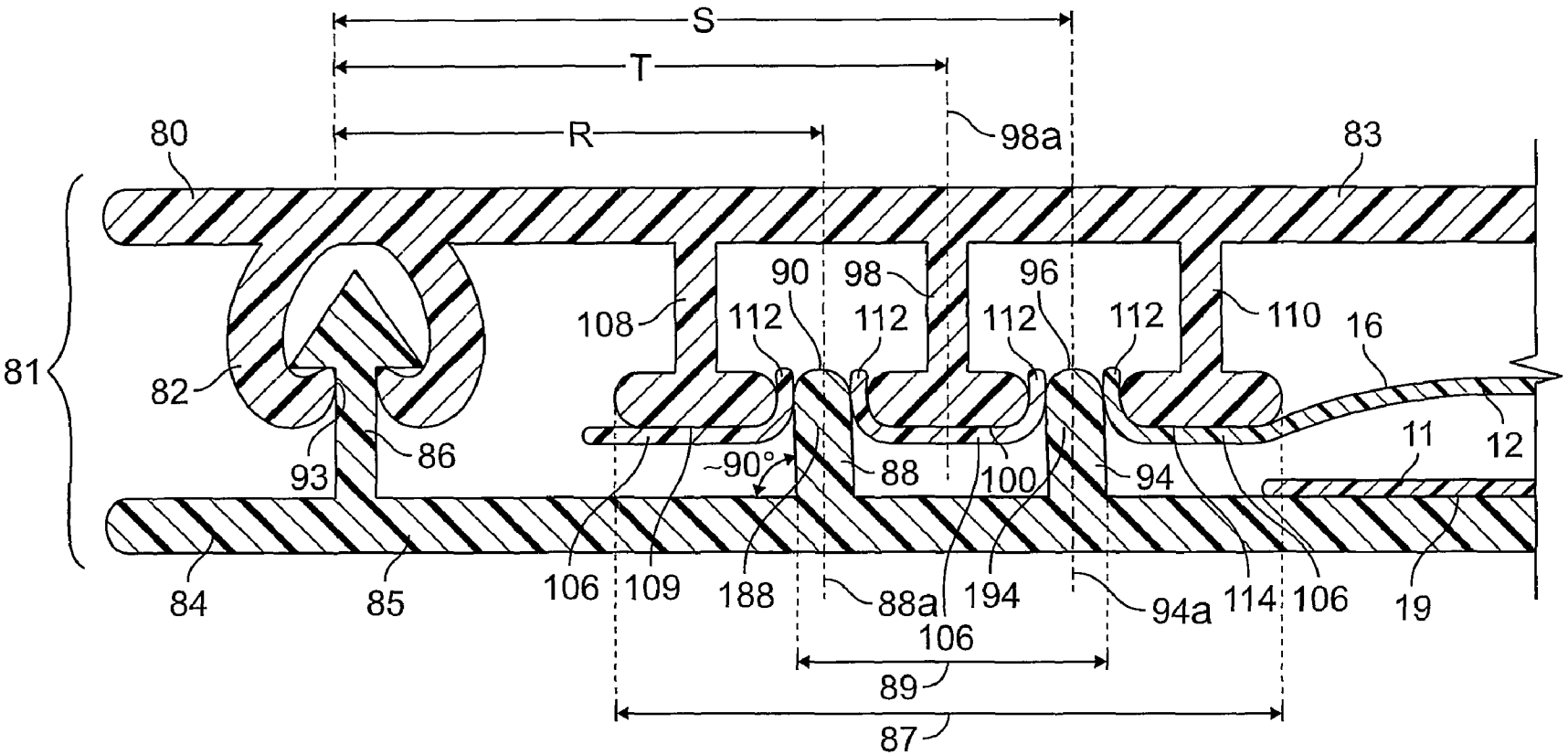
FIG. 4B illustrates an enlarged partial cross-sectional view of the embodiment depicted in FIG. 4A in an occluded state.

Referring to FIGS. 4A and 4B, the closure mechanism 81 includes a first closure element 80 that has a first interlocking profile 82 and a second closure element 84 that includes a complementary second interlocking profile 86. FIG. 4A depicts the first and second closure elements 80, 84 in a non-occluded state while FIG. 4B shows the first and second closure elements 80, 84 in an occluded state. In this embodiment, the first closure element 80 is attached to the outer surface 16 of the second sidewall 12, and the second closure element 84 is attached to an outer surface 19 of the first sidewall 11.

A first sealing section 87 disposed on the first closure element 80 includes a first protuberance 98 having a distal surface 100 and extending from an elongate first base 83 of the first closure element. A central axis 98*a* of the first protuberance 98 is located a distance T measured along the first base 83 from a line perpendicular to the base and through a distal end 93 of the first interlocking profile 82. The first sealing section 87 also includes a second and third protuberance, 108, 110 respectively positioned on either side of the first protuberance 98. The second and third protuberances 108, 110 extend from the elongate first base 83 of the first closure element 80 and have respective distal surfaces 109, 114. A second sealing section 89 disposed on the second closure element 84 includes a first sealing member 88 having a distal surface 90 disposed at an apex of a fourth protuberance 188 that extends approximately 90 degrees or perpendicularly from an elongate second base 85 of the second closure element. A central axis 88*a* of the distal surface 90 generally corresponds in this embodiment to that of the first sealing member 88 and is located a distance R measured along the first base 83 from a line perpendicular to the base and through the distal end 93 of the first interlocking profile 82 when the closure elements 80 and 84 are occluded. The second sealing section 89 further includes a second sealing member 94 having a distal surface 96 that is disposed at an apex of a fifth protuberance 194 and also extends approximately 90 degrees or perpendicularly from the elongate second base 85 of the second closure element 84. A central axis 94*a* of the distal surface 96 also generally corresponds to that of the second sealing member 94 and is located a distance S measured along the first base 83 from a line perpendicular to the base and through the distal end 93 of the first interlocking profile 82 when the closure elements 80 and 84 are occluded. In this embodiment, the distance S is greater than the distance T, which is greater than the distance R. Although both of the first and second sealing members 88, 94 have generally perpendicularly disposed respective fourth and fifth protuberances 188, 194, it is also contemplated that one or both may be disposed at an angle less than 90 degrees. The first closure element 80 may also include a third interlocking profile (not shown) on a product side of the first sealing section 87, and the second closure element 84 may include a complementary fourth interlocking profile (not shown) on the product side of the second sealing section 89.

A sealing flange 106 is attached respectively to the distal surfaces 100, 109, 114 of the first, second, and third protuberances, 98, 108, 110, respectively. In this embodiment, the sealing flange 106 is a part of the second sidewall 12. However, in other embodiments, the sealing flange 106 may be made of a thermoplastic film independent of the sidewalls 11, 12 such as, for example, an elastomer or a polyolefin plastomer such as an AFFINITY™ resin. The sealing flange 106 also includes a slit along a length thereof to form film flaps 112 to allow penetration of the first and second sealing members 88, 94 into spaces between the first protuberance 98 and the second protuberance 108 and the first protuberance 98 and the third protuberance 110, respectively, when the first closure element 80 and second closure element 84 are occluded. In the occluded state shown in FIG. 4B, the film flaps 112 are urged against respective surfaces of the first, second, third, fourth, and fifth protuberances 98, 108, 110, 188, 194 to form airtight seals between the first and second sealing members 88, 94 and the sealing flange 106. However, in other embodiments not shown, the first and second sealing members 88, 94 may be further spaced from the respective first, second, and third protuberances 98, 108, 110. In these embodiments, the film flaps 112 form an airtight seal with the first and second sealing members 88, 94 and have little or no contact with the respective surfaces of the first, second, and third protuberances 98, 108, 118. In FIGS. 4A and 4B, the sidewalls of the first through fifth protuberances 98, 108, 110, 188, 194 are substantially parallel and perpendicular relative to the elongate first and second bases 83, 85, but it is contemplated that any angle or shaped wall including straight, curved, arched, or serpentine, for example, may be used.

Figure 5A:
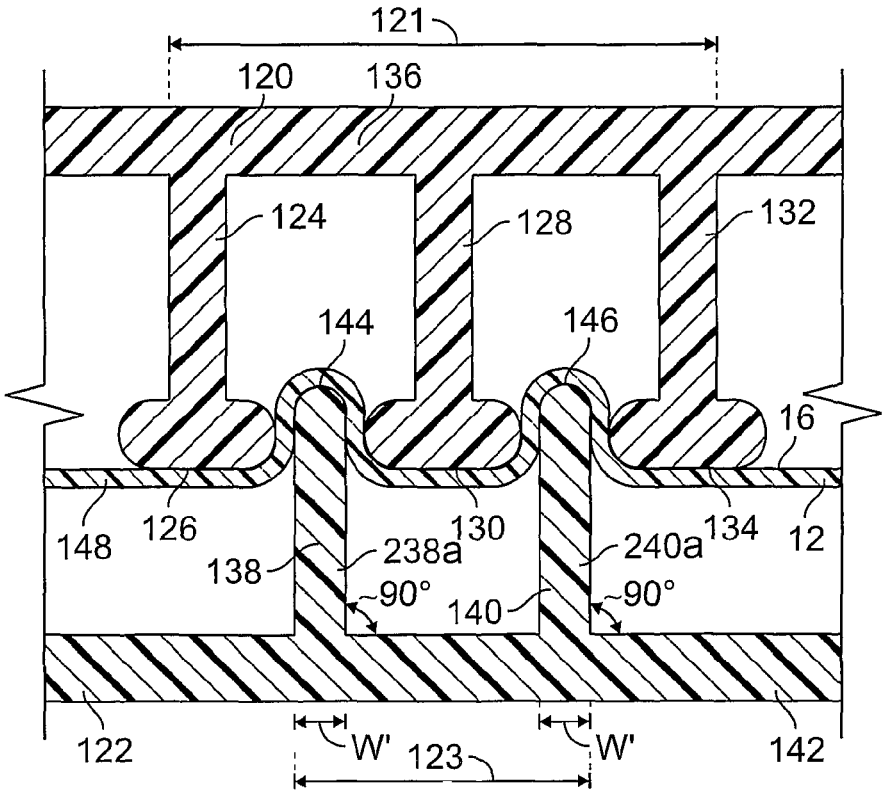
FIG. 5A is an enlarged partial cross-sectional view of a fourth embodiment taken generally along the lines 2-2 of FIG. 1.
Figure 5B:
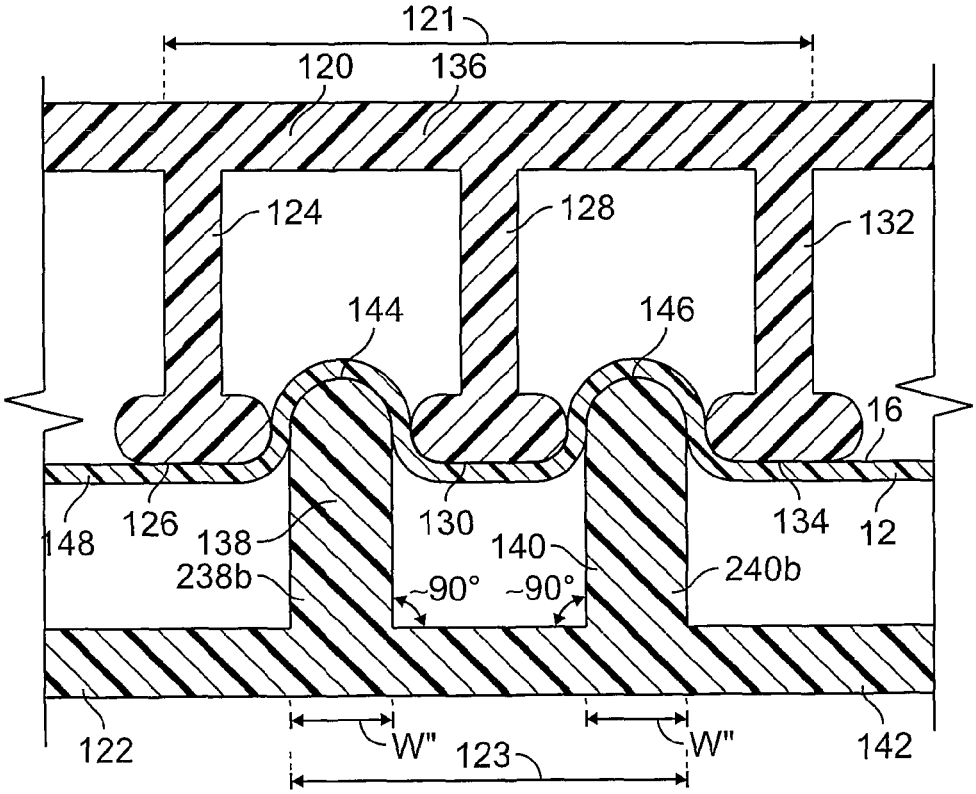
FIG. 5B is an enlarged partial cross-sectional view of a fifth embodiment taken generally along the lines 2-2 of FIG. 1.

Referring to FIGS. 5A and 5B, a first closure element 120 is attached to the outer surface 16 of the second sidewall 12 and a second closure element 122 is attached (not shown) either to the inner or outer surfaces 15, 17 of the first sidewall 11. A first sealing section 121 includes a first protuberance 124 having a distal surface 126, a second protuberance 128 having a distal surface 130, and a third protuberance 132 having a distal surface 134, wherein each of the protuberances 124, 128, 132 extends from an elongate first base 136 of the first closure element 120. A second sealing section 123 includes a first sealing member 138 having a distal surface 144 and a second sealing member 140 having a distal surface 146, wherein each of the first and second sealing members 138, 140 extends approximately perpendicularly or about 90 degrees from an elongate second base 142 of the second closure element 122. A sealing flange 148 extends across and is attached to the distal surfaces 126, 130, 134 of the first, second, and third protuberances 124, 128, 132 respectively. In the occluded state, each of the first and second sealing members 138, 140 is urged against the sealing flange 148 to form an airtight seal therebetween. In this embodiment, the sealing flange 148 is a part of the second sidewall 12. However, in other embodiments, the sealing flange 148 may be made of a thermoplastic film independent of the sidewalls 11, 12 such as, for example, an elastomer or a polyolefin plastomer such as an AFFINITY™ resin.

In FIG. 5A, each sealing member, 138, 140 has a respective fourth and fifth protuberance 238*a*, 240*a* that each has a width of W'. In FIG. 5B, each of the fourth and fifth protuberances 238*b*, 240*b* has a width of W". The increased width (W") of each of the fourth and fifth protuberances 238*b*, 240*b* in FIG. 5B relative to each of the fourth and fifth protuberances 238*a*, 240*a* of width W' in FIG. 5A results in an increased surface area upon which to contact the sealing flange 148. The increase in surface area results in a larger portion of the sealing flange 148 being contacted by the first and second sealing members 138, 140 in the occluded state, which may enhance sealing performance. Other ways to enhance sealing performance, include, for example, creating a tighter interference fit between the sealing flange 148 and one or more of the sealing members such as the first and second sealing members 138, 140. Illustratively, this can be achieved by increasing the length of the fourth or fifth protuberances 238*a*, 238*b*, or 240*a*, 240*b*, or the length of one or more of the first, second, or third protuberances 124, 128, 132. When the respective closure elements 120, 122 are urged together and become occluded, greater force may be required to occlude the closure elements due to a greater force required to urge the first and second sealing members 138, 140 and the sealing flange 148 together to form an airtight seal. Still other ways to enhance sealing performance, include, for example, using a thicker web or using multiple plies of material (not shown) to form a thicker sealing flange 148, or using a more resilient material to create a tighter interference fit between the first and second sealing members 138, 140 and the sealing flange.

Although the present invention has been described relative to specific exemplary embodiments thereof, it will be understood by those skilled in the art that modifications can be made thereto without departing from the scope and spirit of the invention.

INDUSTRIAL APPLICATION

An airtight closure mechanism is presented that may be used to pack and store perishable items in an airtight or vacuum environment. The closure mechanism includes first and second closure elements, wherein each of the closure elements has interlocking and sealing sections. A sealing flange is attached across the sealing section of one of the first and second closure elements, and the other of the first and second closure elements includes a sealing member. When the first and second closure elements are occluded, the sealing member is urged against the sealing flange and forms an airtight seal therebetween.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. An airtight closure mechanism for a reclosable pouch, comprising:

first and second complementary closure elements, the first closure element comprising a first interlocking profile and the second closure element comprising a complementary second interlocking profile; and first and second sealing sections disposed on respective complementary sides of the first and second interlocking profiles, the first sealing section comprising a first protuberance having a first distal surface, a second protuberance having a second distal surface, and a sealing flange attached to and extending between the first and second distal surfaces of the first and second protuberances, respectively, and the second sealing section comprising a sealing member disposed on a base of the second closure element and located a distance from the second interlocking profile that places a distal surface thereof between the first and second protuberances when the first and second interlocking profiles are occluded;

wherein when the first and second interlocking profiles are occluded, the distal surface urges against the sealing flange to form an airtight seal therebetween.

2. The airtight closure mechanism of claim 1, wherein the first and second closure elements are elongate and disposed along an opening of the pouch, and one or more of the closure profiles includes a textured portion along the length of each profile to provide tactile and/or audible sensations when the closure mechanism is occluded.

3. The airtight closure mechanism of claim 1, wherein the first closure element is attached on an outer surface of a first pouch sidewall and the second closure element is attached to an inner surface of a second pouch sidewall.

4. The airtight closure mechanism of claim 3, wherein the sealing flange comprises the first pouch sidewall.

5. The airtight closure mechanism of claim 1 further comprising a third protuberance disposed on the second closure element and adapted to releasably interlock with the first protuberance when the first and second interlocking profiles are occluded.

6. The airtight closure mechanism of claim 5, wherein the third protuberance comprises a hook portion to releasably interlock with the first protuberance.

7. The airtight closure mechanism of claim 1, wherein the first interlocking profile and the first protuberance are integral.

8. The airtight closure mechanism of claim 1, wherein the sealing flange comprises a slit disposed therein to allow penetration of the distal surface into a space between the first protuberance and the second protuberance when the first and second closure elements are occluded.

9. The airtight closure mechanism of claim 1, wherein the first and second protuberances independently comprise a post, a bulbous member, a T-shaped member, an arrow or half-arrow shaped member, or a rectangular, square-shaped, round, or triangular-shaped protrusion.

10. The airtight closure mechanism of claim 1, wherein the first and second interlocking profiles are female and male closure profiles, respectively.

11. A reclosable pouch, comprising:

first and second pouch sidewalls sealed to one another to define an opening;

a one-way valve disposed on or in at least one of the first or second pouch sidewalls;

an airtight closure mechanism comprising first and second closure elements that include first and second interlocking profiles, and first and second sealing sections, respectively;

the first closure element attached to the first sidewall and the second closure element attached to the second sidewall proximate the opening to define a pouch interior; and the first and second sealing sections disposed on respective pouch interior sides of the first and second interlocking profiles, the first sealing section comprising a first protuberance having a first distal surface, a second protuberance having a second distal surface, and a sealing flange attached to and extending across the first and second distal surfaces of the first and second protuberances, respectively, and the second sealing section comprising a sealing member disposed on a base of the second closure element and located a distance from the second interlocking profile that places a distal surface thereof between the first and second protuberances when the first and second interlocking profiles are occluded;

wherein when the first and second interlocking profiles are occluded, the sealing member urges against the sealing flange to form an airtight seal therebetween.

12. The pouch of claim 11, wherein one or more of the closure profiles includes a textured portion along the length of each profile to provide tactile and/or audible sensations when the closure mechanism is occluded.

13. The pouch of claim 11, wherein at least one of the pouch sidewalls comprises air channels in fluid communication with the valve.

14. The pouch of claim 11, wherein at least one or more of the first and second pouch sidewalls comprises a barrier layer.

15. The pouch of claim 14, wherein the barrier layer comprises EVOH.

16. An airtight sealing section for a closure mechanism, comprising:

first and second sealing sections disposed on respective complementary sides of first and second closure elements, the first sealing section comprising a first protuberance having a first distal surface, a second protuberance having a second distal surface, and a sealing flange attached to and extending across from the first and second distal surfaces of the first and second protuberances, respectively, and the second sealing section comprising a sealing member disposed on the second closure element and located on a base of the second closure element so as to urge against the sealing flange attached to and extending across from the first and second protuberances when the first and second closure elements are occluded to form an airtight seal therebetween.

17. The airtight sealing section of claim 16, wherein the sealing flange comprises the first pouch sidewall.

18. The airtight sealing section of claim 16, wherein the sealing flange comprises a slit disposed therein to allow penetration of the sealing member into a space between the first protuberance and the second protuberance when the first and second closure elements are occluded.

19. The airtight sealing section of claim 16, wherein at least one of the first or second closure elements are attached to an exterior side of a pouch wall.

20. The airtight sealing section of claim 16, wherein the sealing flange comprises at least one of an elastomer or polyolefin plastomer layer.

* * * * *